US010640858B2

(12) United States Patent
Detor et al.

(10) Patent No.: US 10,640,858 B2
(45) Date of Patent: May 5, 2020

(54) METHODS FOR PREPARING SUPERALLOY ARTICLES AND RELATED ARTICLES

(71) Applicant: General Electric Company, Schenectady, NY (US)

(72) Inventors: Andrew Joseph Detor, Albany, NY (US); Richard DiDomizio, Charlton, NY (US); Timothy Hanlon, Town Glenmont, NY (US); Chen Shen, Schenectady, NY (US); Ning Zhou, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 626 days.

(21) Appl. No.: 15/198,658

(22) Filed: Jun. 30, 2016

(65) Prior Publication Data

US 2018/0002794 A1 Jan. 4, 2018

(51) Int. Cl.

| | |
|---|---|
| ***C22F 1/10*** | (2006.01) |
| ***C22C 19/05*** | (2006.01) |
| ***C22C 19/03*** | (2006.01) |

(52) U.S. Cl.

CPC ..... *C22F 1/10* (2013.01); *C22C 19/03* (2013.01); *C22C 19/05* (2013.01); *C22C 19/055* (2013.01); *C22C 19/056* (2013.01)

(58) Field of Classification Search

None

See application file for complete search history.

(56) References Cited

U.S. PATENT DOCUMENTS 3,519,419 A 7/1970 Gibson et al.
3,705,827 A 12/1972 Muzyka et al.
(Continued)

FOREIGN PATENT DOCUMENTS

| | | | |
|---|---|---|---|
| EP | 2 479 302 | A1 | 7/2012 |
| JP | 2015193870 | A | 11/2015 |
| WO | 2015008343 | A1 | 1/2015 |

OTHER PUBLICATIONS

Banhart et al. (Gamma'/Gamma" Co-Precipitation in Inconel 706 Alloy: A 3D finite Element Study; Materials Science and Engineering A 417; 82-29; 2006).*

Extended European Search Report and Opinion issued in connection with corresponding EP Application No. 17178125.5 dated Nov. 27, 2017.

(Continued)

*Primary Examiner* — Guinever S Gregorio

(74) *Attorney, Agent, or Firm* — The Small Patent Law Group LLC; Philip S. Hof

(57) ABSTRACT

A method for preparing an improved article including a nickel-based superalloy is presented. The method includes heat-treating a workpiece including a nickel-based superalloy at a temperature above the gamma-prime solvus temperature of the nickel-based superalloy and cooling the heat-treated workpiece with a cooling rate less than 50 degrees Fahrenheit/minute from the temperature above the gamma-prime solvus temperature of the nickel-based superalloy so as to obtain a cooled workpiece. The cooled workpiece includes a coprecipitate of a gamma-prime phase and a gamma-double-prime phase, wherein the gamma-prime phase of the coprecipitate has an average particle size less than 250 nanometers. An article having a minimum dimension greater than 6 inches is also presented. The article includes a material having a coprecipitate of a gamma-prime phase and a gamma-double-prime phase, wherein the gamma-prime phase of the coprecipitate has an average particle size less than 250 nanometers.

9 Claims, 4 Drawing Sheets

(56) References Cited

U.S. PATENT DOCUMENTS

| | | | | |
|---|---|---|---|---|
| 3,871,928 | A | 3/1975 | Smith, Jr. et al. | |
| 4,236,943 | A | 12/1980 | Korenko et al. | |
| 4,574,015 | A | 3/1986 | Genereux et al. | |
| 4,769,087 | A | 9/1988 | Genereux et al. | |
| 4,888,253 | A | 12/1989 | Snyder et al. | |
| 5,788,785 | A | 8/1998 | DeLuca et al. | |
| 6,315,846 | B1 | 11/2001 | Hibner et al. | |
| 8,313,593 | B2 * | 11/2012 | Hawk | C22C 19/055 148/427 |
| 8,524,149 | B2 | 9/2013 | Sato et al. | |
| 8,663,404 | B2 | 3/2014 | Yang et al. | |
| 8,668,790 | B2 | 3/2014 | Yang et al. | |
| 8,889,064 | B2 | 11/2014 | Raisson | |
| 2004/0050460 | A1 | 3/2004 | Nazmy et al. | |
| 2012/0037280 | A1 | 2/2012 | Devaux | |
| 2013/0133793 | A1 * | 5/2013 | McDevitt | C22C 19/055 148/707 |
| 2013/0153089 | A1 | 6/2013 | Ajdelsztajn et al. | |
| 2013/0228302 | A1 | 9/2013 | Rickenbacher et al. | |
| 2014/0127525 | A1 | 5/2014 | Kamoshida et al. | |
| 2015/0368774 | A1 | 12/2015 | Ota et al. | |
| 2016/0068932 | A1 * | 3/2016 | Uehara | C22C 19/05 420/443 |
| 2018/0002793 | A1 | 1/2018 | Detor et al. | |

OTHER PUBLICATIONS

Cozar et al.,"Morphology of Y' and Y" Precipitates and Thermal Stability of Inconel 718 Type Alloys", Metallurgical Transactions, Jan. 1973, vol. 4, pp. 47-59.

Mitchell et al.,"The influence of cooling rate from temperatures above the γ' solvus on morphology, mismatch and hardness in advanced polycrystalline nickel-base superalloys",Materials Science and Engineering A, 2008, pp. 158-165.

Murray et al., "Microstructural and Thermal Processing Effects on Adding 3W/O Ti to a Powder Metallurgy Processed Ni—Cr—Fe Alloy", Aerospace Materials and Manufacturing : Advances in Materials, Processes and Repair Technologies, Proceedings of the 49th Conference of Metallurgists of CIM, available from http://web.cim.org/com2015/conference/COM2010_Aerospace-BOOK.pdf,1 Page.

Phillips et al.,"Nano γ'/γ" composite precipitates in Alloy 718", Applied Physics Letters 100, 2012, 4 Pages.

Mignanelli et al., "The influence of Al:Nb ratio on the microstructure and mechanical response of quaternary Ni—Cr—Al—Nb alloys", Materials Science and Engineering A, vol. 612, 2014, pp. 179-186.

J. Belan, "High Frequency Fatigue Test of In 718 Alloy—Microstructure and Fractography Evaluation", Metalurgija, vol. 54, Issue 1, 2015, pp. 59-62.

* cited by examiner

METHODS FOR PREPARING SUPERALLOY ARTICLES AND RELATED ARTICLES

STATEMENT REGARDING FEDERALLY SPONSORED RESEARCH AND DEVELOPMENT

This invention was made with Government support under contract number DE-FE0026299 awarded by the U.S. Department of Energy. The Government has certain rights in the invention.

CROSS REFERENCE TO RELATED APPLICATIONS

This application is related to a patent application titled "METHODS FOR PREPARING SUPERALLOY ARTICLES AND RELATED ARTICLES," filed on Jun. 30, 2016 under Ser. No. 15/198,514.

BACKGROUND

Embodiments of the present disclosure generally relate to metal alloys for high temperature service, for example superalloys. More particularly, embodiments of the present disclosure relate to methods for preparing articles comprising nickel-based superalloys which are used for manufacture of components used in high temperature environments such as, for example, turbine engines.

The remarkable strength of superalloys is primarily attributable to the presence of a controlled dispersion of one or more hard precipitate phases within a comparatively more ductile matrix phase. For instance, nickel-based superalloys can be strengthened by one or more intermetallic compounds, generally known as "gamma-prime" and "gamma-double-prime." In general, articles may be prepared by thermomechanically processing these superalloys to achieve a precipitation dispersion of one or more of the gamma-prime phase and the gamma-double-prime phase having desired particle size and morphology. Controlled particle size and morphology may provide a balance of the desirable properties in the superalloy articles. However, the gamma-prime phase in conventional superalloys is generally subject to severe over-aging during thermomechanical processing of the superalloy while manufacturing a large article (having a minimum dimension greater than 6 inches). Improved methods for preparing articles of the superalloys to achieve controlled gamma-prime particle size and morphology are desirable.

BRIEF DESCRIPTION

Provided herein are alternative methods for preparing improved articles comprising nickel-based superalloys. In one aspect, a method for preparing an article includes heat-treating a workpiece comprising a nickel-based superalloy at a temperature above a gamma-prime solvus temperature of the nickel-based superalloy and cooling the heat-treated workpiece with a cooling rate less than 50 degrees Fahrenheit/minute from the temperature above the gamma-prime solvus temperature of the nickel-based superalloy so as to obtain a cooled workpiece. The cooled workpiece comprises a coprecipitate of a gamma-prime phase and a gamma-double-prime phase at a concentration of at least 10 percent by volume of a material of the cooled workpiece. The gamma-prime phase of the coprecipitate has an average particle size less than 250 nanometers.

In another aspect, a method for preparing an article includes heat-treating a workpiece comprising a nickel-based superalloy at a temperature above a gamma-prime solvus temperature of the nickel-based superalloy and cooling the heat-treated workpiece with a cooling rate less than 10 degrees Fahrenheit/minute from the temperature above the gamma-prime solvus temperature of the nickel-based superalloy so as to obtain a cooled workpiece comprising a coprecipitate of a gamma-prime phase and a gamma-double-prime phase at a concentration of at least 20 percent by volume of a material of the cooled workpiece, wherein the gamma-prime phase of the coprecipitate has an average particle size less than 100 nanometers. The nickel-based superalloy includes at least 30 weight percent nickel; from about 0.2 weight percent to about 4 weight percent titanium, from about 0.2 weight percent to about 4 weight percent tantalum or from about 0.2 weight percent to about 4 weight percent of a combination of titanium and tantalum thereof; from about 0.2 weight percent to about 3 weight percent aluminum; and from about 1.5 weight percent to about 7 weight percent niobium, wherein an atomic ratio of titanium to aluminum, an atomic ratio of tantalum to aluminum or an atomic ratio of the combination of titanium and tantalum to aluminum is in a range from about 0.2 to about 2.

In a further aspect, an article includes a material comprising at least 30 weight percent nickel; from about 0.1 weight percent to about 6 weight percent titanium, from about 0.1 weight percent to about 6 weight percent tantalum or from about 0.1 weight percent to about 6 weight percent of a combination of titanium and tantalum; from about 0.1 weight percent to about 6 weight percent aluminum; and from about 0.5 weight percent to about 9 weight percent niobium, wherein an atomic ratio of titanium to aluminum, an atomic ratio of tantalum to aluminum or an atomic ratio of the combination of titanium and tantalum to aluminum is in a range from about 0.1 to about 4. The material further comprises a coprecipitate comprising a gamma-prime phase and a gamma-double-prime phase dispersed within a matrix phase at a concentration of at least 10 percent by volume of the material, wherein the gamma-prime phase has an average particle size less than 250 nanometers. The article has a minimum dimension greater than 6 inches.

DRAWINGS

These and other features, aspects, and advantages of the present disclosure will become better understood when the following detailed description is read with reference to the accompanying drawings, wherein.

DETAILED DESCRIPTION

Figure 1:
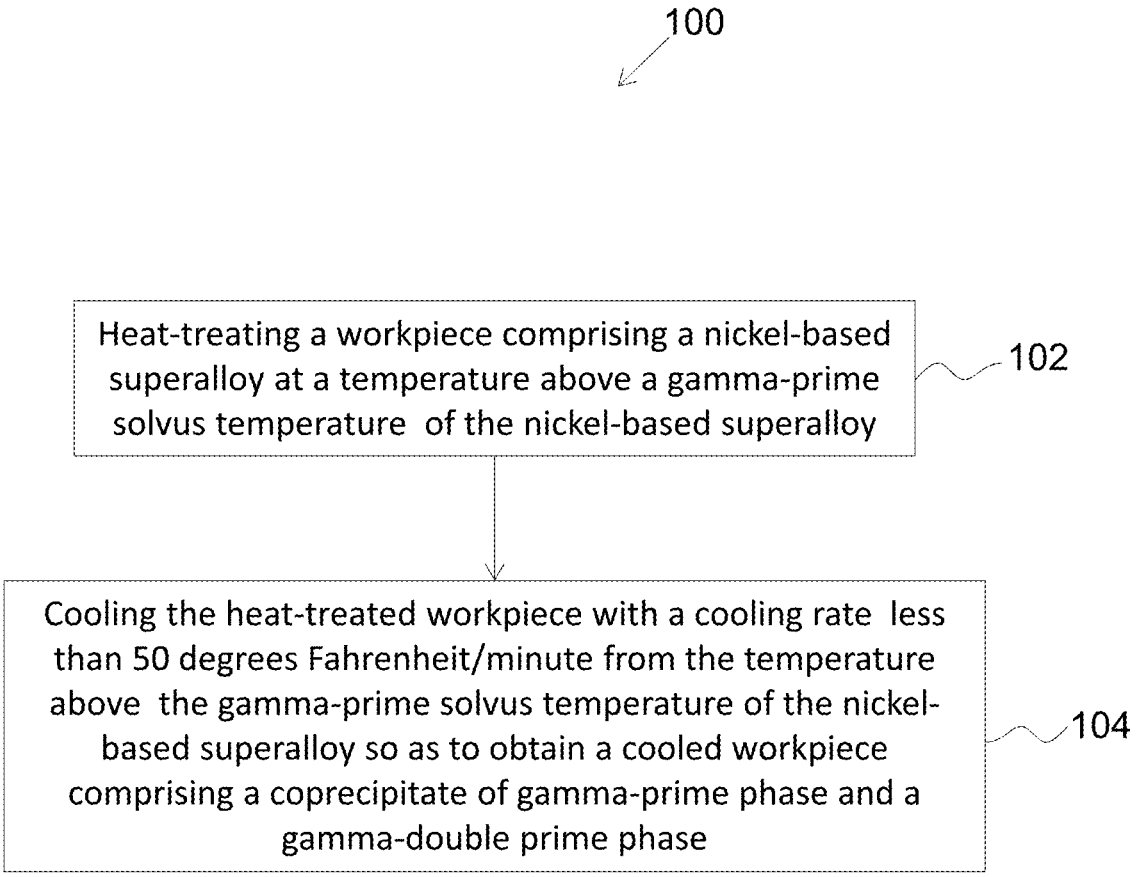
FIG. 1 is a flow chart of a method for preparing an article, in accordance with one embodiment of the methods described herein.

The disclosure generally encompasses thermomechanical processing that can be performed on a wide variety of alloys, and particularly alloys, such as superalloys, that are capable of being hardened/strengthened during thermomechanical processing via precipitates. As used herein, the term "superalloy" refers to a material strengthened by a precipitate dispersed in a matrix phase. Commonly known examples of superalloys include gamma-prime precipitation-strengthened nickel-based superalloys and gamma-double-prime precipitation-strengthened nickel-based superalloys. The term "nickel-based" generally means that the composition has a greater amount of nickel present than any other constituent element.

Typically, in gamma-prime precipitation-strengthened nickel-based superalloys, one or more of chromium, tungsten, molybdenum, iron and cobalt are principal alloying elements that combine with nickel to form the matrix phase and one or more aluminum, titanium, tantalum, niobium, and vanadium are principal alloying elements that combine with nickel to form a desirable strengthening precipitate of gamma-prime phase, that is $Ni_3(Al, X)$, where X can be one or more of titanium, tantalum, niobium and vanadium. In gamma-double-prime precipitation-strengthened nickel-based superalloys, nickel and niobium generally combine to form a strengthening phase of body-centered tetragonal (bct) $Ni_3(Nb, X)$, where X can be one or more of titanium, tantalum and aluminum, in a matrix phase containing nickel and one or more of chromium, molybdenum, iron and cobalt. The precipitate of nickel-based superalloys can be dissolved (i.e., solutioned) by heating the superalloys above their solvus temperature or a solutioning temperature, and re-precipitated by an appropriate cooling and aging treatment. These nickel-based superalloys can be generally engineered to produce a variety of high-strength components having the desired precipitate strengthening phases and morphology for achieving the desired performance at high temperatures for various applications.

A component comprising a nickel-based superalloy is typically produced by forging a billet formed by powder metallurgy or casting techniques. In a powder metallurgy process, the billet can be formed by consolidating a starting superalloy powder by, for example hot isostatic pressing (HIP) or compaction consolidation. The billet is typically forged at a temperature at or near the recrystallization temperature of the nickel-based superalloy and below the gamma-prime solvus temperature of the nickel-based superalloy. After forging, a heat-treatment is performed, during which the nickel-based superalloy may be subject to over aging. The heat-treatment is performed at a temperature above the gamma-prime solvus temperature (but below an incipient melting temperature) of the nickel-based superalloy to recrystallize the worked microstructure and dissolve any precipitated gamma-prime phase in the nickel-based superalloy. Following the heat-treatment, the component is cooled at an appropriate cooling rate to re-precipitate the gamma-prime phase so as to achieve the desired mechanical properties. The component may further undergo aging using known techniques. The component may then be processed to final dimensions via known machining methods.

As discussed previously, conventional manufacturing methods may not be suitable for attaining a controlled and fine gamma-prime precipitate phase (for example, having an average particle size <250 nanometers) in the nickel-based superalloy for achieving improved mechanical properties at high temperatures, particularly in large articles or components (for example, components having a minimum dimension >6 inches). The gamma-prime precipitate phase in the nickel-based superalloys may be subject to over-aging at high temperatures (near the gamma-prime solvus temperature) if exposed to these temperatures for a duration of time greater than half an hours because the heating and cooling of large components is slower as compared to relatively smaller components (for example, components having a minimum dimension <6 inches). The thermomechanical processing of large components of a nickel-based superalloy may therefore result in coarsening of the gamma-prime precipitate phase, which is detrimental to the desired mechanical properties. For example, an average particle size of gamma-prime precipitate phase in a conventional nickel-based superalloy (for example, Rene'88DT) component may be greater than 1 micron.

As discussed in detail below, provided herein are improved methods for preparing an article including a nickel-based superalloy. The described embodiments provide methods for achieving a controlled particle size (<250 nanometers) of the gamma-prime phase in articles including nickel-based superalloys. This controlled particle size (<250 nanometers) of the gamma-prime phase may also be referred to as fine gamma-prime phase.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value.

Unless defined otherwise, technical and scientific terms used herein have the same meaning as is commonly understood by one of skill in the art to which this disclosure belongs. The terms "comprising," "including," and "having" are intended to be inclusive, and mean that there may be additional elements other than the listed elements.

As used herein, the term "high temperature" refers to a temperature higher than 1000 degrees Fahrenheit. In some embodiments, the high temperature refers to an operating temperature of a turbine engine.

FIG. 1 illustrates, in one embodiment, a method 100 for preparing an article from a workpiece including a nickel-based superalloy. The method 100 includes the step 102 of heat treating the workpiece at a temperature above the gamma-prime solvus temperature of the nickel-based superalloy, and the step 104 of cooling the heat-treated workpiece with a cooling rate less than 50 degrees Fahrenheit/minute from the temperature above the gamma-prime solvus temperature of the nickel-based superalloy so as to obtain a cooled workpiece including a coprecipitate of gamma-prime phase and a gamma-double-prime phase at a concentration of at least 10 percent by volume of a material of the cooled workpiece. The gamma-prime phase in the coprecipitate has an average particle size less than 250 nanometers.

The term "workpiece", as used herein, refers to an initial article prepared from a starting material by thermomechanical processing for example billetizing followed by mechanical working. In some embodiments, the workpiece is the initial article prepared by the thermomechanical processing before carrying out the heat-treatment step. As discussed previously, the workpiece may be prepared, for example by casting processes or powder metallurgy processing followed by mechanical working to provide a nickel-based superalloy as described herein. The mechanical working step introduces strain into the microstructure to a desired level. In some embodiments, the mechanical working step includes conventional processing such as forging, extrusion, and rolling; or the use of a severe plastic deformation (SPD) process such as multi-axis forging, angular extrusion, twist extrusion, or high pressure torsion; or combinations thereof.

In some embodiments, the nickel-based superalloy includes at least 30 weight percent nickel. In some embodiments, the nickel-based superalloy includes from about 0.1 weight percent to about 6 weight percent aluminum. In some embodiments, aluminum is present in a range from about 0.2 weight percent to about 3 weight percent. In some embodiments, aluminum is present in a range from about 0.5 weight percent to about 1.5 weight percent. In some embodiments, the nickel-based superalloy includes from about 0.5 weight percent to about 9 weight percent niobium. In some embodiments, niobium is present in a range from about 1.5 weight percent to about 7 weight percent. In some embodiments, niobium is present in a range from about 3 weight percent to about 5.5 weight percent. In some embodiments, the nickel-based superalloy includes from about 0.1 weight percent to about 6 weight percent titanium, from about 0.1 weight percent to about 6 weight percent tantalum or from about 0.1 weight percent to about 6 weight percent of a combination of titanium and tantalum. In some embodiments, titanium, tantalum or the combination or titanium and tantalum may be in a range from about 0.2 weight percent to about 4 weight percent. In some embodiments, titanium, tantalum or the combination of titanium and tantalum may be in a range from about 0.5 to about 2 weight percent.

The term, "weight percent", as used herein, refers to a weight percent of each referenced element in the nickel-based superalloy based on a total weight of the nickel-based superalloy, and is applicable to all incidences of the term "weight percent" as used herein throughout the specification.

In some embodiments, the nickel-based superalloy has a composition including at least 30 weight percent nickel; from about 0.1 weight percent to about 6 weight percent aluminum; from about 0.5 weight percent to about 9 weight percent niobium; and from about 0.1 weight percent to about 6 weight percent titanium, from about 0.1 weight percent to about 6 weight percent tantalum or from about 0.1 weight percent to about 6 weight percent of a combination of titanium and tantalum. In some embodiments, the composition of the nickel-based superalloy includes from about 0.2 weight percent to about 3 weight percent aluminum; from about 1.5 weight percent to about 7 weight percent niobium; and from about 0.2 weight percent to about 4 weight percent titanium, from about 0.2 weight percent to about 4 weight percent tantalum or from about 0.2 weight percent to about 4 weight percent of the combination of titanium and tantalum. In some embodiments, the composition of the nickel-based superalloy includes from about 0.5 weight percent to about 1.5 weight percent aluminum; from about 3 weight percent to about 5.5 weight percent niobium; and from about 0.5 weight percent to about 2 weight percent titanium, from about 0.5 weight percent to about 2 weight percent tantalum, or from about 0.5 weight percent to about 2 weight percent of the combination of titanium and tantalum.

The composition of the nickel-based superalloy is further controlled to maintain an atomic ratio of titanium to aluminum, an atomic ratio of tantalum to aluminum or an atomic ratio of the combination of titanium and tantalum to aluminum in a range from about 0.1 to about 4. In some embodiments, the atomic ratio is maintained in a range from about 0.2 to about 2. In certain embodiments, the atomic ratio is maintained in a range from about 0.4 to about 1.5. Controlling the atomic ratio in a given range as described herein helps to maintain a balance of gamma-prime phase and gamma-double-prime phase in the coprecipitate.

The nickel-based superalloy may further include additional elements. In some embodiments, the nickel-based superalloy further includes from about 10 weight percent to about 30 weight percent chromium, from 0 weight percent to about 45 weight percent cobalt, from 0 weight percent to about 40 weight percent iron, from 0 weight percent to about 4 weight percent molybdenum, from 0 weight percent to about 4 weight percent tungsten, from 0 weight percent to about 2 weight percent of hafnium, from 0 weight percent to about 0.1 weight percent of zirconium, from 0 weight percent to about 0.2 weight percent of carbon, from 0 weight percent to about 0.1 weight percent of boron or combinations thereof.

In some particular embodiments, the nickel-based superalloy includes from about 10 weight percent to about 20 weight percent chromium, from 10 weight percent to about 40 weight percent cobalt, from 10 weight percent to about 20 weight percent iron, from 1 weight percent to about 4 weight percent molybdenum, from 1 weight percent to about 4 weight percent tungsten, from 1 weight percent to about 2 weight percent of hafnium, from 0.05 weight percent to about 0.1 weight percent of zirconium, from 0.1 weight percent to about 0.2 weight percent of carbon, from 0.05 weight percent to about 0.1 weight percent of boron or combinations thereof.

One example of the nickel-based superalloy includes from about 11 weight percent to about 15 weight percent chromium, from 15 weight percent to about 25 weight percent iron, from 1 weight percent to about 4 weight percent molybdenum, from about 0.5 weight percent to about 1.5 weight percent aluminum, from about 3 weight percent to about 6 weight percent niobium, from about 0.5 weight percent to about 2 weight percent titanium, from 0.1 weight percent to about 0.2 weight percent of carbon, and balance essentially nickel. The atomic ratio of titanium to aluminum is in a range as described above.

Referring to FIG. 1, the step 102 of heat-treating the workpiece may be performed upon heating the workpiece to a temperature above the gamma-prime solvus temperature of the nickel-based superalloy. As used herein, the term "gamma-prime solvus temperature" refers to a temperature above which, in equilibrium, the gamma-prime phase is unstable and dissolves. The gamma-prime solvus temperature is a characteristic of each particular nickel-based superalloy composition. The gamma-prime solvus temperature of the nickel-based superalloy as described herein is in a range from about 1400 degrees Fahrenheit to about 2200 degrees Fahrenheit.

In some embodiments, the heat-treatment step 102 includes solution-treating the workpiece at a temperature above the gamma-prime solvus temperature of the nickel-based superalloy. The heat-treatment step 102 may be carried out for a period of time from about 1 hour to about 10 hours. The heat-treatment step 102 may be performed to dissolve substantially any gamma-prime phase in the nickel-based superalloy. In some embodiments, the heat-treatment step 102 is performed at a temperature at least 100 degrees above the gamma-prime solvus temperature. In some embodiments, the temperature may be higher than about 300 degrees above the gamma-prime solvus temperature.

Following the heat-treatment step 102, the method 100 further includes the step 104 of cooling the heat-treated workpiece from the temperature above the gamma-prime solvus temperature of the nickel-based superalloy. The step 104 of cooling the heat-treated workpiece can be performed with a controlled manner, for example with a slow cooling rate that is less than 50 degrees Fahrenheit/minute. According to some embodiments, the cooling step 104 is performed by cooling the heat-treated workpiece with a cooling rate less than 20 degrees Fahrenheit/minute. In yet some embodiments, the cooling rate is less than 10 degrees Fahrenheit/minutes. In some embodiments, the cooling rate is in a range from about 1 degree Fahrenheit/minute to about 5 degrees Fahrenheit/minute. In certain embodiments, the cooling rate is as slow as 1 degree Fahrenheit/minute. In some embodiments, the cooling rate may be less than 1 degree Fahrenheit/minute. In one embodiment, the cooling step 104 is performed upon cooling the heat-treated workpiece to a room temperature. In some embodiments, the cooling step 104 is performed upon cooling the heat-treated workpiece to an aging temperature.

The cooling as described herein is conducted in a direction through a minimum dimension of a workpiece. As used herein, the term "minimum dimension" refers to a dimension that is smaller than any other dimension of a workpiece or an article as described herein. In some embodiments, a length, a width, a radius or a thickness of the workpiece or the article may be a smallest dimension of the workpiece or the article. In some embodiments, the minimum dimension of a workpiece or an article is the thickness of the workpiece or the article. In some embodiments, a workpiece or an article may have multiple thicknesses, where a minimum dimension of the workpiece or the article is the smallest thickness of the workpiece or the article. In these embodiments, the cooling rate is a cooling rate across the smallest thickness of the workpiece. Based on various sections having varying thicknesses, a cooling rate in a thicker section (having a thickness greater than a smallest thickness) of the workpiece may be relatively slower than a cooling rate in a section having the smallest thickness. It will be understood that cooling at any cooling rate described herein across the smallest dimension of a workpiece (e.g., across the smallest thickness) provides the most efficient cooling rate for any workpiece described herein, although there may be instances where cooling across a dimension other than the smallest dimension may be desirable.

The cooling step as described herein may promote the nucleation of the gamma-prime phase and the gamma-double-prime phase within the microstructure of the nickel-based superalloy. The cooling step 104 may allow for obtaining a cooled workpiece that includes a coprecipitate having a gamma-prime phase and gamma-double-prime phase. As used herein, the term "cooled workpiece" refers to a workpiece including a nickel-based superalloy received after cooling the heat-treated workpiece as described herein by a cooling rate less than 50 degrees Fahrenheit/minute to a temperature below the gamma-prime solvus temperature of the nickel-based superalloy. In some embodiments, the cooled workpiece is received at room temperature. The cooled workpiece as described herein may also be referred to as a slow cooled workpiece. The nickel-based superalloy composition in the cooled workpiece is also referred to as "material".

As used herein, the term "coprecipitate" refers to a precipitate having a gamma-prime phase in direct contact with a gamma-double-prime phase. In some embodiments, the gamma-prime phase of the coprecipitate forms a core and the gamma-double-prime phase forms a coating on the core. In such embodiments, the coprecipitate includes particles having a core of the gamma-prime phase substantially coated with a gamma-double-prime phase. As used herein, the term "substantially coated" means that higher than 50 percent surface of the core of the gamma-prime phase is coated with the gamma-double-prime phase. In some embodiments, higher than 70 percent surface of the core of the gamma-prime phase is coated with the gamma-double-prime phase.

The coprecipitate may be present in the material of the cooled workpiece at a concentration of at least 10 percent by volume of the material of the cooled workpiece. In some embodiments, the coprecipitate is present at a concentration of at least 20 percent by volume of the material of the cooled workpiece. In some embodiments, the concentration of the coprecipitate is in a range from about 20 percent by volume to about 60 percent by volume of the material of the cooled workpiece. In some embodiments, the concentration of the coprecipitate is in a range from about 30 percent by volume to about 50 percent by volume of the material of the cooled workpiece. The coprecipitate may exist in the material as a plurality of particulates distributed within a matrix phase.

In the coprecipitate as described herein, the gamma-prime phase, for example the cores of the coprecipitate particles, may have an average particle size less than 250 nanometers. In some embodiments, the gamma-prime phase of the coprecipitate has an average particle size less than 200 nanometers. In some embodiments, the gamma-prime phase of the coprecipitate has an average particle size in a range from about 10 nanometers to about 200 nanometers. In certain embodiments, the gamma-prime phase of the coprecipitate has an average particle size less than 100 nanometers. In some embodiments, the gamma-prime phase of the coprecipitate has an average particle size in a range from about 10 nanometers to about 100 nanometers.

Without being limited by any theory, it is believed that the presence of aluminum, niobium, and one or both titanium and tantalum in specific amounts as described herein in the nickel-based superalloy enables the formation of a coprecipitate having gamma-prime phase and gamma-double-prime phase, as described herein. The formation of such a coprecipitate may help to control or prevent the coarsening of the gamma-prime phase and provides fine gamma-prime phase (having particle size <250 nanometers) in the material of the slow cooled workpiece.

The method may further include machining the cooled workpiece to form the article. In some embodiments, the method includes the step of aging the cooled workpiece before machining. The aging step may be performed by heating the cooled workpiece at an aging temperature in a range from about 1300 degrees Fahrenheit to about 1600 degrees Fahrenheit. This aging treatment may be performed at a combination of time and temperature selected to achieve the desired properties.

Some embodiments are directed to an article. In some embodiments, the article includes a material that includes a composition of the nickel-based superalloy as described herein, and further includes a coprecipitate having a gamma-prime phase and a gamma-double-prime phase dispersed in a matrix phase. The coprecipitate is present in the material at a concentration of at least 10 percent by volume of the material. The gamma-prime phase in the coprecipitate has an average particle size less than 250 nanometers. Further details of the coprecipitate are described previously. In some embodiments, an article is prepared by the method as described herein.

The article may be a large component having a minimum dimension greater than 6 inches. In some embodiments, the article has a minimum dimension greater than 8 inches. In some embodiments, the article has a minimum dimension greater than 10 inches. In some embodiments, the minimum dimension of the article is in a range from about 8 inches to about 20 inches.

Examples of such large components include components of gas turbine assemblies and jet engines. Particular non-limiting examples of such components include disks, wheels, vanes, spacers, blades, shrouds, compressor components and combustion components of land-based gas turbine engines. It is understood that articles other than turbine components for which the combination of several mechanical properties such as strength and ductility are desired, are considered to be within the scope of the present disclosure.

Some embodiments of the present disclosure advantageously provide a coprecipitate of gamma-prime phase and gamma-double-prime phase during manufacturing an article including a nickel-based superalloy, and thus enable controlling of a fine gamma-prime phase (average particle size <250 nanometers). Such embodiments thus allow the preparation of large articles (having a minimum thickness >6 inches) such as components of turbine engines of nickel-based superalloys with improved mechanical properties at high temperatures by controlling coarsening of the gamma-prime phase and thus retaining fine gamma-prime phase in the resulting article.

EXAMPLES

The following example illustrates methods, materials and results, in accordance with a specific embodiment, and as such should not be construed as imposing limitations upon the claims.

Preparation of Sample Workpieces Including Nickel-Based Superalloys

Experimental Example 1: Sample Workpieces (1-2)

Two materials (1-2) were produced from sample superalloy compositions as given in table 1 via vacuum induction melting process, yielding ingots of approximately 1⅜" diameter×3" tall. A ratio of Ti/Al was 0.5 and 1 in atomic percent (at %) for the two superalloy compositions.

Differential scanning calorimetry (DSC) was used to measure the gamma-prime solvus temperatures of the sample superalloy compositions. A sample workpiece was cut from each ingot after forging. The two sample workpieces 1 and 2 were subjected to the following homogenization heat-treatment. Each sample workpiece (1-2) was solution heat-treated to a temperature of about 2175 degrees Fahrenheit for a time period of about 24 hours followed by slow cooling at a cooling rate of about 1 degree Fahrenheit/minute from about 2175 degrees Fahrenheit to room temperature. After heat-treatment and cooling, the cooled sample workpieces 1 and 2 were prepared using conventional metallographic techniques and etched to reveal any precipitation.

TABLE 1

| Sample superalloy composition | Weight percent (wt. %) | | | | | | | | Ti/Al atomic percent |
|---|---|---|---|---|---|---|---|---|---|
| | Ni | Cr | Fe | Al | Ti | Nb | Mo | C | (at %) |
| Sample workpiece 1 | 52.9 | 18.7 | 18.9 | 1.07 | 0.95 | 4.42 | 3.05 | 0.02 | 0.5 |
| Sample workpiece 2 | 53.7 | 18.7 | 18.9 | 0.68 | 1.21 | 3.77 | 3.05 | 0.02 | 1.0 |

Comparative Example 2: Sample Workpieces (3-4)

Sample workpieces 3 and 4 were prepared from commercial alloy compositions Rene'88DT and Haynes® 282® by using the same method used in example 1, except that the sample workpieces 3 and 4 were solution heat-treated respectively to the temperatures above the gamma-prime solvus temperatures of the alloy compositions Rene'88DT and Haynes® 282® and then slow cooled from the solution heat-treatment temperatures.

Testing of Sample Workpieces (1-4)

Figure 2:
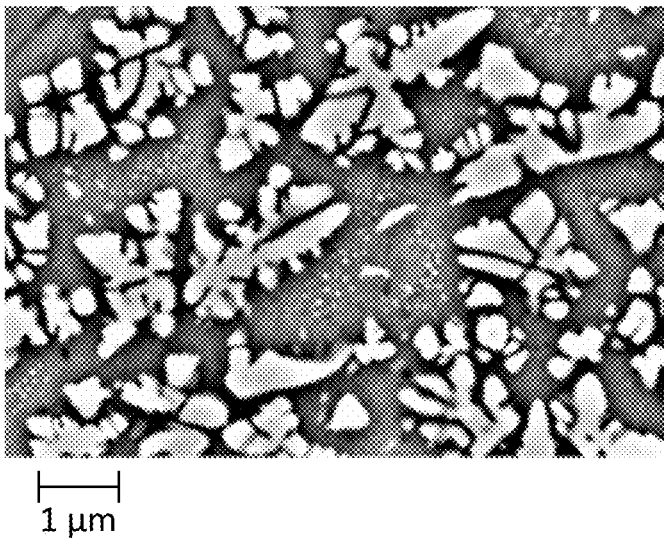
FIG. 2 is a micrograph of a portion of an article prepared using a conventional nickel-based superalloy composition.
Figure 3:
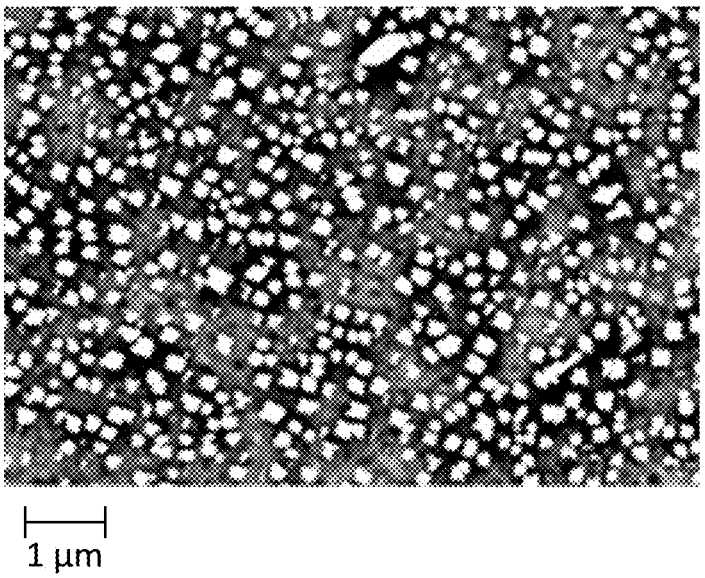
FIG. 3 is a micrograph of a portion of an article prepared using another conventional nickel-based superalloy composition.
Figure 4:
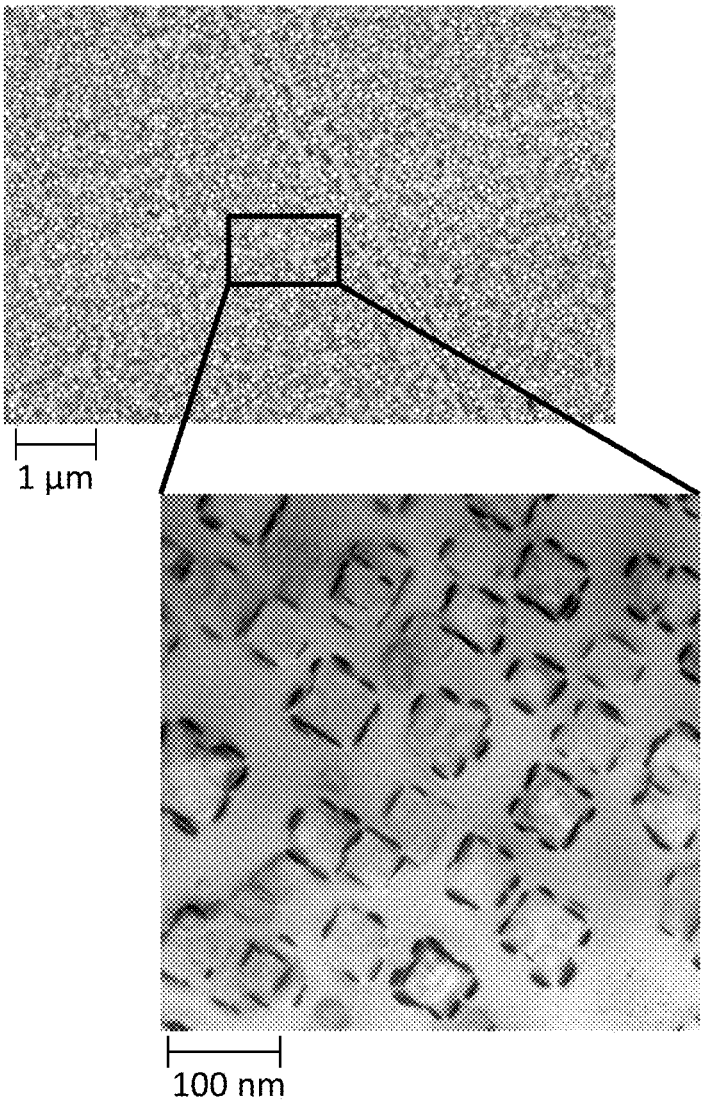
FIG. 4 is a micrograph of an article prepared by a method in accordance with one embodiment of the methods described herein.
Figure 5:
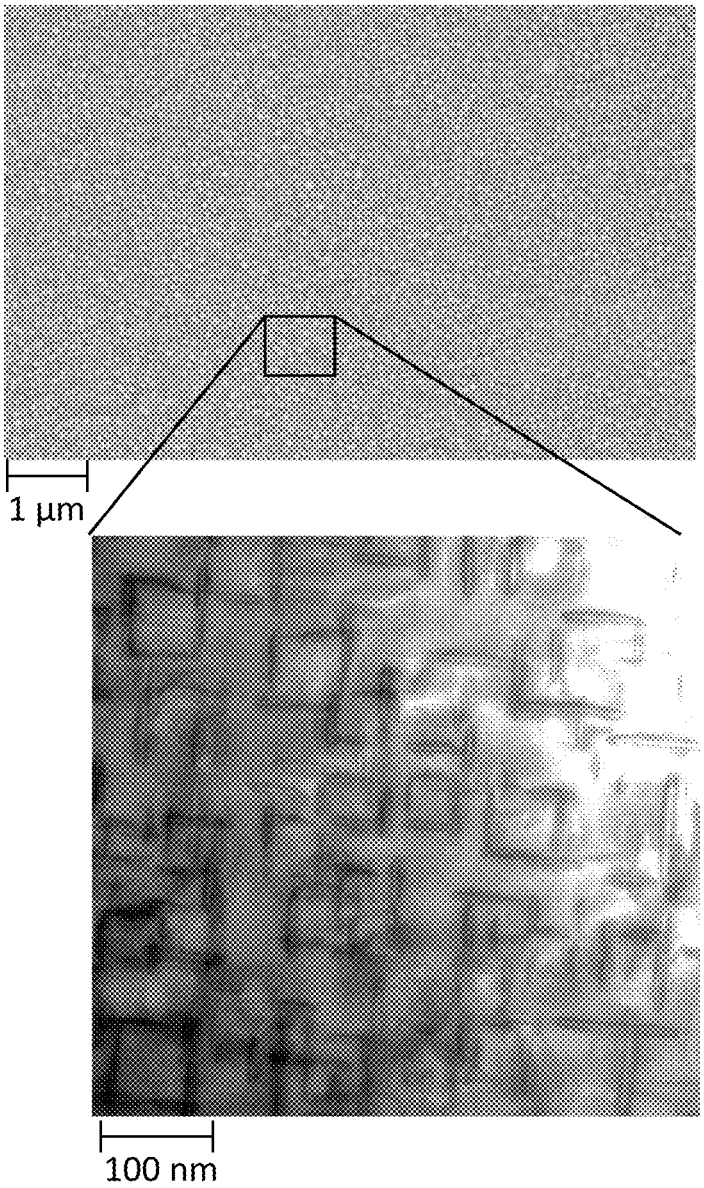
FIG. 5 is a micrograph of an article prepared by a method in accordance with another embodiment of the methods described herein

The microstructure of each sample workpiece (1-4) was then examined in a scanning electron microscope (SEM). It was observed that the comparative sample workpieces 3 and 4 of commercial alloy compositions had gamma-prime phase having an average particle size >250 nanometers, which implied that the sample workpieces 3 and 4 were subject to over aging during slow cooling. FIGS. 2 and 3 show SEM images for sample workpieces 3 and 4. In contrast, experimental sample workpieces 1 and 2 had an average particle size ≤100 nanometers. FIGS. 4 and 5 show SEM images of sample workpieces 1 and 2. Sample workpieces 1 and 2 were further examined at higher magnification in a transmission electron microscope (TEM) to characterize details of the precipitating phase(s). TEM analysis confirmed the coprecipitation of the gamma-prime and gamma-double-prime phases in the sample workpieces 1 and 2. It was also observed from SEM images (FIGS. 4 and 5) of the sample workpieces 1 and 2 that multiple gamma-double-prime phase particles had nucleated and grown on the surface of gamma-prime phase particles of size ≤100 nanometers.

Accordingly, the superalloy compositions of sample workpieces 1 and 2 in conjunction with a slow cooling rate of about 1 degree Fahrenheit/minute allow for the formation of the coprecipitate as described herein having a gamma-prime phase of an average particles size ≤100 nanometers in the materials of the slow cooled workpieces.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. An article comprising:

a material comprising:

at least 30 weight percent nickel;

from about 0.1 weight percent to about 6 weight percent titanium, from about 0.1 weight percent to about 6 weight percent tantalum or from about 0.1 weight percent to about 6 weight percent of a combination of titanium and tantalum;

from about 0.1 weight percent to about 6 weight percent aluminum; and from about 0.5 weight percent to about 9 weight percent niobium, wherein an atomic ratio of titanium to aluminum, an atomic ratio of tantalum to aluminum or an atomic ratio of the combination of titanium and tantalum to aluminum is in a range from about 0.2 to about 2;

wherein the material further comprises a coprecipitate comprising a gamma-prime phase and a gamma-double-prime phase dispersed within a matrix phase at a concentration of at least 10 percent by volume of the material, wherein the gamma-prime phase has an average particle size less than 250 nanometers, wherein the article has a minimum dimension greater than 6 inches.

2. The article of claim 1, wherein the material comprises:

from about 0.2 weight percent to about 4 weight percent titanium, from about 0.2 weight percent to about 4 weight percent tantalum or from about 0.2 weight percent to about 4 weight percent of a combination of titanium and tantalum;

from about 0.2 weight percent to about 3 weight percent aluminum; and from about 1.5 weight percent to about 7 weight percent niobium.

3. The article of claim 1, wherein the material further comprises from about 10 weight percent to about 30 weight percent chromium, from 0 weight percent to about 45 weight percent cobalt, from 0 weight percent to about 40 weight percent iron, from 0 weight percent to about 4 weight percent molybdenum, from 0 weight percent to about 4 weight percent tungsten, from 0 weight percent to about 2 weight percent of hafnium, from 0 weight percent to about 0.1 weight percent of zirconium, from 0 weight percent to about 0.2 weight percent of carbon, from 0 weight percent to about 0.1 weight percent of boron or combinations thereof.

4. The article of claim 1, wherein the gamma-prime phase has an average particle size less than 200 nanometers.

5. The article of claim 1, wherein the gamma-prime phase has an average particle size less than 100 nanometers.

6. The article of claim 1, wherein the article has a minimum dimension greater than 8 inches.

7. The article of claim 1, wherein the coprecipitate comprises the gamma-prime phase in direct contact with the gamma-double-prime phase.

8. The article of claim 1, wherein the article is one or more of a disk, vane, blade, or shroud of an engine.

9. The article of claim 1, wherein the material further comprises from about 0.1 weight percent to about 0.2 weight percent of carbon.

* * * * *